US006299919B1

(12) United States Patent
Knaus et al.

(10) Patent No.: US 6,299,919 B1
(45) Date of Patent: Oct. 9, 2001

(54) PACKAGING CONTAINER FOR SLICED FOODSTUFFS, IN PARTICULAR CHEESE SLICES

(75) Inventors: Jürgen Knaus, Lindenberg; Hans Wurm, Heimenkirch, both of (DE)

(73) Assignee: Hochland Reich, Summer & Co., Heimenkirch (DE)

( * ) Notice: Subject to any disclaimer, the term of this patent is extended or adjusted under 35 U.S.C. 154(b) by 0 days.

(21) Appl. No.: 09/315,197

(22) Filed: May 19, 1999

(30) Foreign Application Priority Data

Dec. 18, 1998 (DE) ..... 298 22 607 U

(51) Int. Cl.[7] ..... B65D 85/76; B65D 85/62

(52) U.S. Cl. ..... 426/115; 426/130; 206/815; 206/555

(58) Field of Search ..... 426/130, 129, 426/115, 119; 206/815, 804, 555

(56) References Cited

U.S. PATENT DOCUMENTS

| | | | | |
|---|---|---|---|---|
| 796,558 | * | 8/1905 | Bowman | 206/815 |
| 1,433,560 | * | 10/1922 | Lund | 206/815 |
| 2,834,686 | * | 5/1958 | Reuman | 426/130 |
| 3,224,780 | * | 12/1965 | Mohl | 206/815 |
| 3,407,079 | * | 10/1968 | Griffith et al. | 426/119 |
| 3,414,414 | * | 12/1968 | Christine et al. | 426/119 |
| 3,415,663 | * | 12/1968 | Raschk et al. | 426/129 |
| 4,046,923 | * | 9/1977 | Meng et al. | 426/130 |
| 4,069,348 | | 1/1978 | Bush | 426/119 |
| 4,545,486 | | 10/1985 | Bostic | 206/455 |
| 4,976,370 | | 12/1990 | Cassel | 220/306 |
| 5,167,974 | | 12/1992 | Grindrod et al. | 426/127 |
| 5,204,130 | * | 4/1993 | McDevitt et al. | 426/129 |
| 5,242,696 | * | 9/1993 | McDevitt | 426/130 |
| 5,269,430 | * | 12/1993 | Schlaupitz | 206/815 |
| 5,503,858 | * | 4/1996 | Reskow | 426/129 |
| 5,624,051 | | 4/1997 | Ahern et al. | 220/553 |

FOREIGN PATENT DOCUMENTS

| | | |
|---|---|---|
| 8027805U | 2/1981 | (DE) . |
| 19542505 | 5/1996 | (DE) . |
| 0169154A1 | 1/1986 | (EP) . |
| 0439221A1 | 7/1991 | (EP) . |
| 0765819A1 | 4/1997 | (EP) . |
| 0810162A1 | 12/1997 | (EP) . |
| 2208288A | 3/1989 | (GB) . |
| 0008034424AA | 2/1996 | (JP) . |
| 0009058653AA | 3/1997 | (JP) . |

* cited by examiner

*Primary Examiner*—Steven Weinstein
(74) *Attorney, Agent, or Firm*—Ostrolenk, Faber, Gerb & Soffen, LLP

(57) ABSTRACT

A packaging container, which can be made of plastic, for sliced foodstuffs, in particular cheese slices, with a bottom tray and a cover foil. The foodstuffs are introduced into the bottom tray of the packaging container. The bottom tray is then sealed by the cover foil, and then welded or adhesively bonded or otherwise attached to the bottom tray or to a border around the latter. The invention solves the problem that the consumer faces when foodstuffs are not easily removed from the packaging container. The bottom tray of this invention has recessed grips which allows easy removal of foodstuffs.

2 Claims, 2 Drawing Sheets

PACKAGING CONTAINER FOR SLICED FOODSTUFFS, IN PARTICULAR CHEESE SLICES

BACKGROUND OF THE INVENTION

The innovation concerns a packaging container for sliced foodstuffs, in particular cheese slices, with a bottom tray and a cover foil. It further concerns a packaging container of this type with sliced foodstuffs, preferably cheese slices.

Packaging containers of this type are already known. They can be made of plastic. In the manufacturing operation, the foodstuffs are introduced into the bottom tray of the packaging container. The bottom tray is then sealed by the cover foil, said cover foil being welded or adhesively bonded or otherwise attached to the bottom tray or to a border provided around the latter. In many applications, a closed, tight connection is created between the bottom tray and the cover foil.

However, as regards the packaging of sliced foodstuffs, the consumer is often faced with the problem of being able to remove these easily and reliably from the packaging container.

Taking this as its starting point, the innovation has the object of providing an improved packaging container, of the type mentioned at the outset, which is easier for the consumer to handle.

SUMMARY OF THE INVENTION

According to the innovation, this object is achieved by the fact that the bottom tray has recessed grips. These allow the consumer to easily remove the sliced foodstuffs or cheese slices.

The object on which the innovation is based is further achieved by a packaging container, of the type mentioned at the outset, whose bottom tray has recessed grips and in which sliced foodstuffs, preferably cheese slices, are contained.

Advantageous developments are described in the subclaims.

The recessed grips are preferably arranged on opposite sides of the bottom tray. These are preferably the narrow sides of the customarily rectangular bottom tray. The design with recessed grips arranged on opposite sides of the bottom tray is preferably combined with a further advantageous development according to which the sliced foodstuffs or cheese slices are stacked in a staggered fashion one above the other. When removing the slices stacked in a staggered fashion one above the other, the recessed grips on opposite sides are then alternately used by the consumer to remove the next uppermost slice.

The recessed grips can be arranged diagonally opposite one another.

It is advantageous for the bottom tray to have further recessed grips. These further recessed grips are preferably designed in such a way that they increase the stability of the bottom tray or the packaging container.

The bottom tray is preferably made of plastic. This is preferably transparent plastic.

According to a further advantageous development, the cover foil is resealable. The packaging container is then particularly suitable for foodstuffs which are not used all at once, which is often the case with sliced foodstuffs and cheese slices.

Other features and advantages of the present invention will become apparent from the following description of the invention which refers to the accompanying drawings.

DETAILED DESCRIPTION OF THE INVENTION

Figure 3:
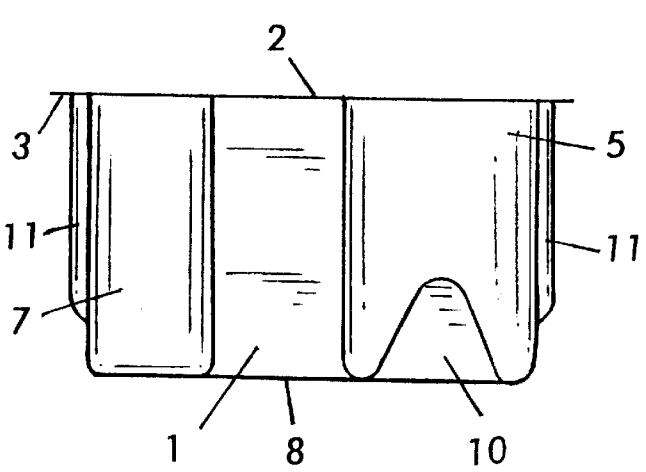
FIG. 3 shows the packaging container according to FIGS. 1 and 2 in a view from the front.
Figure 1:
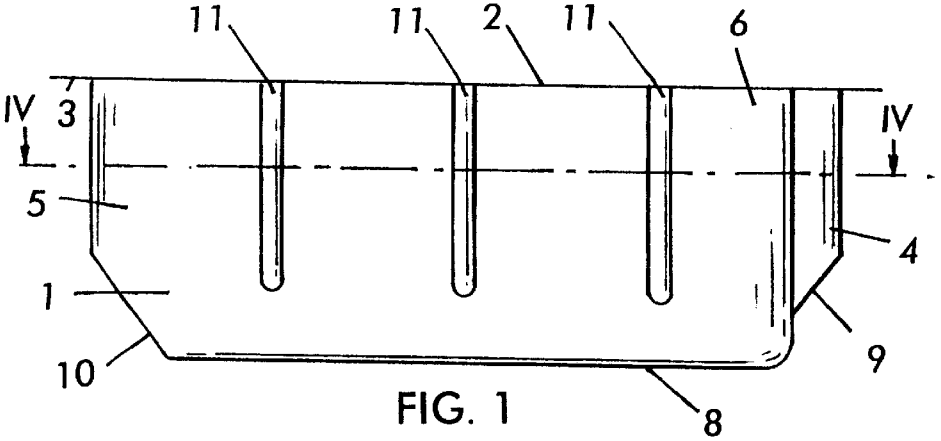
FIG. 1 shows a packaging container in a side view.
Figure 2:
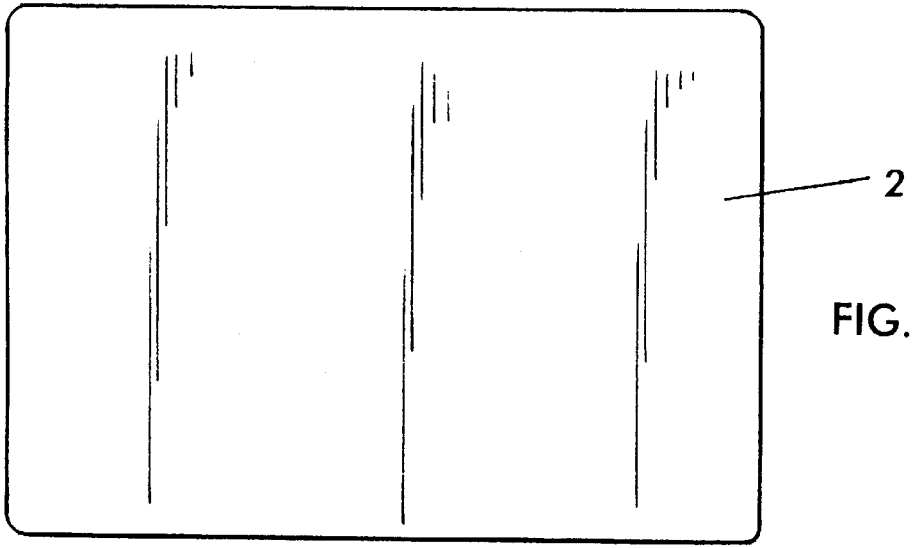
FIG. 2 shows the packaging container according to FIG. 1 in a view from above.

The packaging container consists of a bottom tray 1 and a cover foil 2, which is connected to a border 3 running round the circumference of the bottom tray. The bottom tray 1 (which can also be termed the "bottom foil") consists of transparent plastic, for example APET (PVC) and standard PE. This is a thermo-formable bottom foil.

The cover foil 2 (which can also be termed the "upper foil") likewise consists of plastic, for example printed PET-PVDC (or EVOH) and breakable PE, and said PE can be an anti-fogging PE.

The packaging container can be printed in different colors, the printing preferably being done by intaglio printing. Machining can be done on a thermoforming machine. A suitable material for the cover foil is Pelaseal® (E 68396). The bottom tray can be made from R 5007. The packaging state in the container can be with or without modified atmosphere.

The cover foil is preferably a resealable foil, for example Pelaseal®. The cover foil has an adhesive preferably on its side facing the bottom tray, said adhesive permitting resealing. Resealing is preferably also possible at low temperatures, in particular at refrigerator temperatures. Pelaseal® can be resealed at 0° C.

Other materials can be used for the bottom tray, for example other types of PVC, PP or APET. Here, a nonpeelable PE should be used for sealing. In addition, an opening arrangement can be provided on the bottom tray, for example a tear-off corner, allowing the consumer to check whether the pack has already been opened.

Recessed grips 4, 5 are respectively arranged diagonally opposite each other on the opposite narrow sides of the bottom tray 1. The recessed grips have an approximately semicircular cross section. They are dimensioned so as to offer room for a finger.

Further recesses 6, 7 are arranged on the other opposite corners of the narrow sides, and these further recesses 6, 7 likewise have an approximately semicircular cross section, but are smaller than the recessed grips 4, 5. The further recesses 6, 7 serve to increase the corner stability of the bottom tray.

In their lower area, in which they are connected to the base 8 of the bottom tray 1, the recessed grips 4, 5 each have a bevel 9, 10. Strengthening ribs 11 are provided on the long sides of the bottom tray 1.

Figure 4:
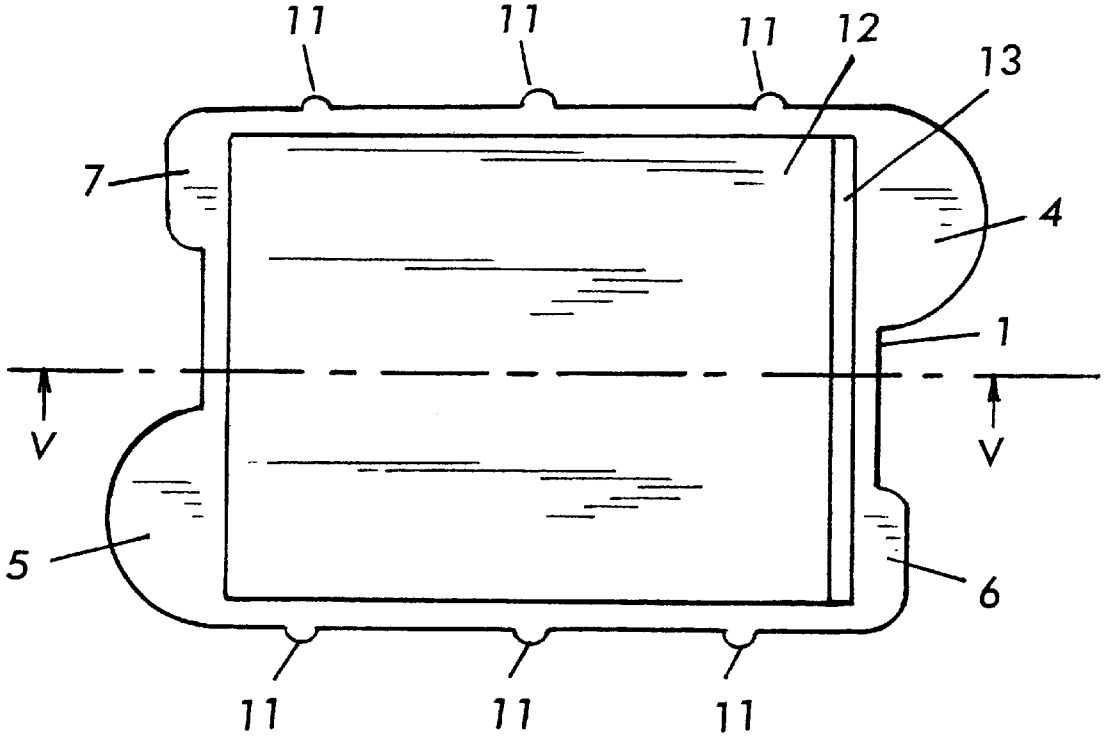
FIG. 4 shows a section along the line IV—IV in FIG. 1.
Figure 5:
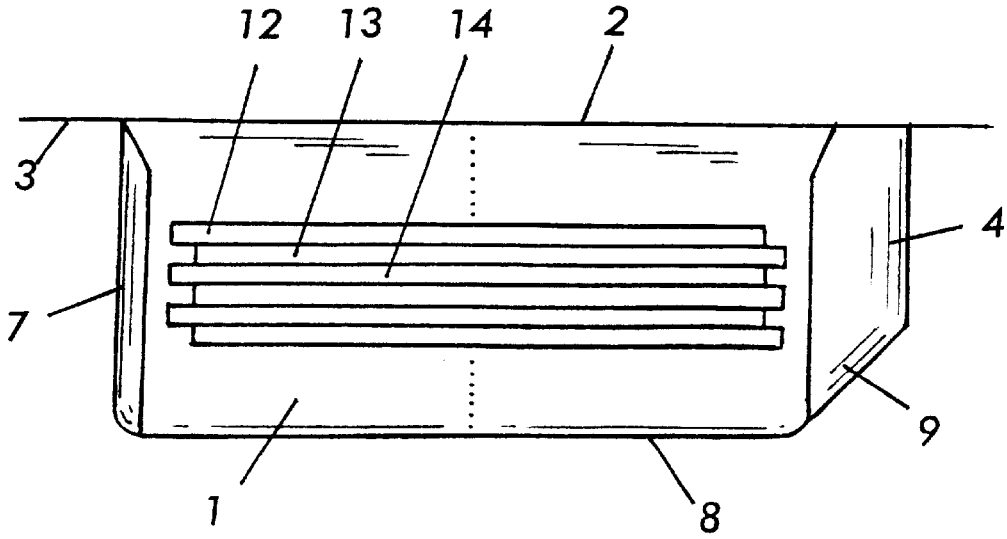
FIG. 5 shows a section along the line V—V in FIG. 4.

It will be seen from FIGS. 4 and 5 that the cheese slices arranged in the packaging container are stacked one above the other in a staggered fashion. They lie flush one above the other along the long sides of the container. The staggering is provided in the area of the narrow sides. For the sake of simplified representation, only a few cheese slices are shown in FIG. 5. The uppermost slice 12 over shoots or extends beyond (see FIG. 5) the next slice 13 in the area of the recessed grip 5. The slice 13 for its part overshoots the next slice 14 in the are of the diagonally opposite recessed grip 4. The subsequent slices are correspondingly arranged, that is to say alternately overlapping each other.

The consumer can easily remove the slice 12 by placing a finger in the recessed grip 5 and gripping under the overlapping end of the slice 12 where slice 12 extends beyond the next slice 13 adjacent the recessed grip. The next slice 13 can then easily be removed by gripping in the opposite recessed grip 4, and so on.

The innovation provides an innovative packaging which has an opening aid and resealing aid (resealable foil) as well as a transparent packaging part with recessed grips for easier removal of the individual slices stacked one above the other in a staggered fashion.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A package containing sliced foodstuffs comprising:

a rectangular tray having an opening to an interior defined by a pair of opposing narrow walls and a pair of opposing longer walls relative to the narrow walls, each wall intersecting two of the other walls wherein a corner is defined by two intersecting walls, and a base intersecting all of the walls and facing the opening in the tray, a resealable cover foil for closing the opening, and a plurality of sliced foodstuffs stacked in an alternating staggered fashion in the interior of the tray, the sliced foodstuffs lie flush one above the other along the longer walls and the staggering is provided along the narrow walls such that each slice of foodstuff overlaps the next lower slice alternately along each respective narrow wall, wherein the tray includes:

two opposing finger channels recessed away from the opening of the tray, each finger channel being disposed on a respective one of the narrow walls adjacent one of two diagonally opposing corners of the tray and each finger channel being wide enough for a person's finger to provide access to the person to retrieve individual slices of the sliced food stuffs from the interior of the tray, such that the sliced foodstuffs are removed from a stack by a person using the two opposing finger channels alternately to remove individual slices, an uppermost slice being removed from the tray by gripping under an extended edge of the uppermost slice by way of one finger channel to expose a next uppermost slice, and then the next uppermost slice being removed by gripping under an extended edge of the next uppermost slice by way of the other opposing finger channel, and two recessed support channels smaller than either of the two recessed finger channels and disposed adjacent opposite corners not occupied by the two opposing recessed finger channels to provide further stability to the tray.

2. The packaging container as claimed in claim 1, wherein the tray is made of transparent plastic.

* * * * *